US011020845B2

(12) United States Patent
Iocco et al.

(10) Patent No.: US 11,020,845 B2
(45) Date of Patent: Jun. 1, 2021

(54) ROUTING ADAPTER FOR WIDE SHALLOW RECESSES

(71) Applicants: Augustine Albert Iocco, Harrison City, PA (US); Matthew Augustine Iocco, Murrysville, PA (US)

(72) Inventors: Augustine Albert Iocco, Harrison City, PA (US); Matthew Augustine Iocco, Murrysville, PA (US)

( * ) Notice: Subject to any disclaimer, the term of this patent is extended or adjusted under 35 U.S.C. 154(b) by 0 days.

(21) Appl. No.: 16/510,898

(22) Filed: Jul. 13, 2019

(65) Prior Publication Data

US 2021/0023689 A1 Jan. 28, 2021

(51) Int. Cl.
*B27C 5/10* (2006.01)
*B25F 3/00* (2006.01)

(52) U.S. Cl.
CPC . *B25F 3/00* (2013.01); *B27C 5/10* (2013.01)

(58) Field of Classification Search
CPC ..... B25F 3/00; B27B 9/02; B27B 5/34; B27C 1/005; B27C 9/005; B27F 5/023; B26D 7/2635
See application file for complete search history.

(56) References Cited

U.S. PATENT DOCUMENTS 1,109,755 A 9/1914 Hunter
2,788,812 A * 4/1957 Jacobs ..... B27G 13/007 144/237
4,913,204 A 4/1990 Moores
6,164,351 A * 12/2000 Weathers ..... B23C 5/08 144/134.1
6,726,414 B2 4/2004 Prientka

* cited by examiner

*Primary Examiner* — Matthew Katcoff

(57) ABSTRACT

A router apparatus for cutting grooves in surfaces at a range of depths includes a housing having a central threaded aperture, a set of saw blades with a diameter less than the aperture. In addition, the apparatus includes at least one handle attached to a side of the housing, an adjustment bushing configured for operational engagement with the central threaded aperture, wherein turning the bushing adjusts the cutting depth of the set of saw blades, and a female coupling opposite the set of cutting blades wherein the female threads are operationally engageable with the male threads of a common right-angle grinder.

3 Claims, 3 Drawing Sheets

ROUTING ADAPTER FOR WIDE SHALLOW RECESSES

FIELD OF THE INVENTION

The present invention relates in general to a router adapter housing and more particularly, this invention relates to a router adapter housing that connects a wide router saw with a right-angle grinder.

BACKGROUND OF THE INVENTION

Woodworking machines, such as routers, which support a vertical rotating spindle that carries a cutting tool for the purpose of forming grooves in lumber are well known; however, conventional routing and similar woodworking machines normally are restricted to one unit. Plunge type routers offer cutting depth adjustment, but over a rather narrow range of cutting diameters for the bits. They all have an integral motor built in. In U.S. Pat. No. 4,913,204, a biscuit planar-jointer is disclosed by Moores et al with an integral drive motor with a drive shaft at a 90-degree angle to the plane of a cutting blade. Prior Art also discloses a typical one piece electric router under patent number U.S. Pat. No. 1,109,755. Another exemplary type of router disclosed by Prientka is show in U.S. Pat. No. 6,726,414. Willets, in British Patent GB 2,350,084, discloses an adaptor for making a right-angle grinder motor into either a router or biscuit planar-jointer. In many respects, the woodworking apparatus according to the present invention substantially departs from the conventional concepts and designs of the prior art, particularly with respect to cutting width and depth adjustment.

SUMMARY OF THE INVENTION

The present invention provides a cost-effective way of attaching a router adapter housing to a standard right angle grinder by way of a threaded coupling. It includes a truncated pyramid housing having a threaded central aperture configured to accommodate an adjustment nut mating with the threaded central aperture and an arbor. A cutting blade is removably fastened to the arbor from the wider underside of the truncated pyramid housing. At least one handle is removably attached to the housing.

OBJECTS OF THE INVENTION

It is therefore one of the primary objects of the present invention is to provide the means of combining the desirable convenience of turning a right angle grinder into a router.

Another object of the present invention is to provide an attachment for a right angle grinder capable of cut width at least three times what typical routers can do.

Still another object of the present invention is to have an adjustable cutting depth with a range of 0" to ⅜" of an inch for the purpose of cutting wide grooves or recesses in lumber.

Still another object of the present invention is to have replaceable blades that are attached by a five bolt pattern arbor.

An additional object of the present invention is to protect the hands and fingers from possible danger with a large shroud on the handles.

Still additional object of the present invention is to have the ability to attach directly to a right angle grinders ⅝"×11 male threaded shaft.

Yet another object of the present invention is to have a base plate that will act as a guide when routing through lumber.

In addition to the various objects and advantages of the present invention described with some degree of specificity above, it should be obvious that additional objects and advantages of the present invention will become more readily apparent to those persons who are skilled in the relevant art from the following more detailed descriptions of the invention, particularly, when such description is taken in conjunction with the attached drawings figures and with the appended claims.

Figure 1:
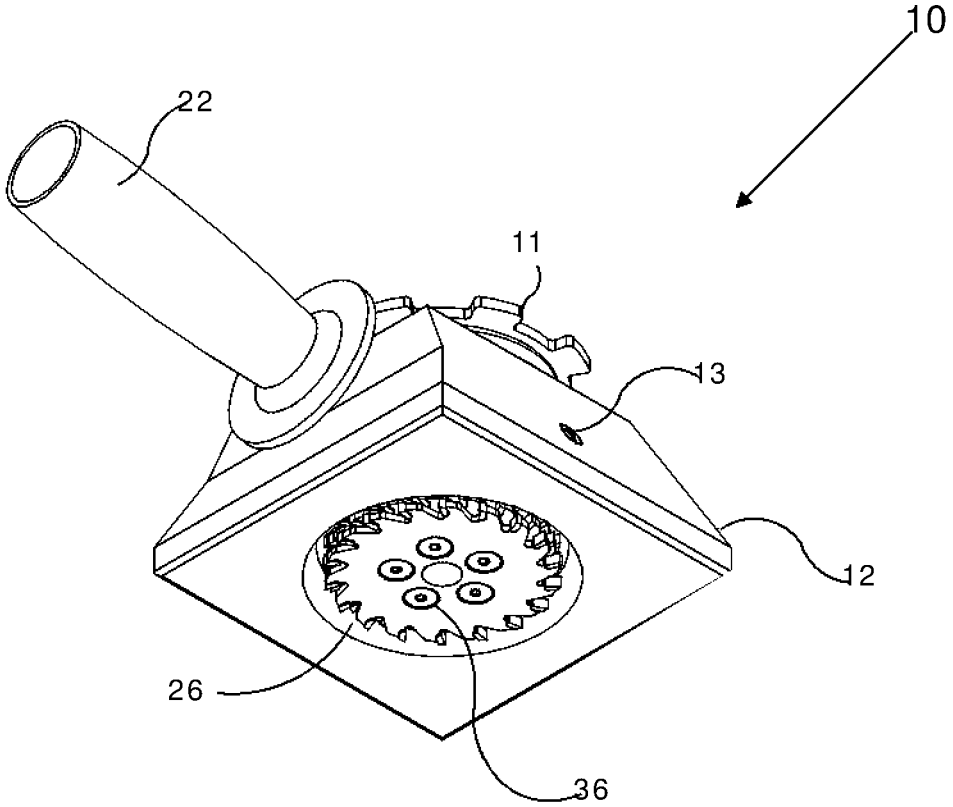
FIG. 1 provides a bottom perspective view of the routing apparatus of the invention.

DETAILED DESCRIPTION OF A PRESENTLY PREFERRED AND VARIOUS ALTERNATIVE EMBODIMENTS OF THE INVENTION

Prior to proceeding to the more detailed description of the present invention, it should be noted that, for the sake of clarity and understanding, identical reference numerals throughout the several views illustrated in the figures.

Referring initially to FIG. 1, this provides a bottom perspective view of the present invention, generally shown as 10. A housing 12, interfaces with a cylindrical aluminum bushing serving as a cutting depth adjuster 11. The depth adjuster 11 may be locked in place by two set screws (15 on FIG. 2) which fit into apertures 13 in the side of the housing 12. The depth adjuster 11 can be unlocked to permit the blades 26, which lie in a plane parallel to the bottom of the housing 12, to be lowered such as to allow the router to cut a wide groove, typically 4 to 8 cm across, and at the exact depth desired to permit a wide planar plate to be installed so as to be flush with the underside of a countertop for reinforcing an overhang. The blades 26 have a second diameter which is less than a first diameter of a second aperture in the bottom of the housing such that the blades 26 can move in and out to determine cutting depth.

Figure 2:
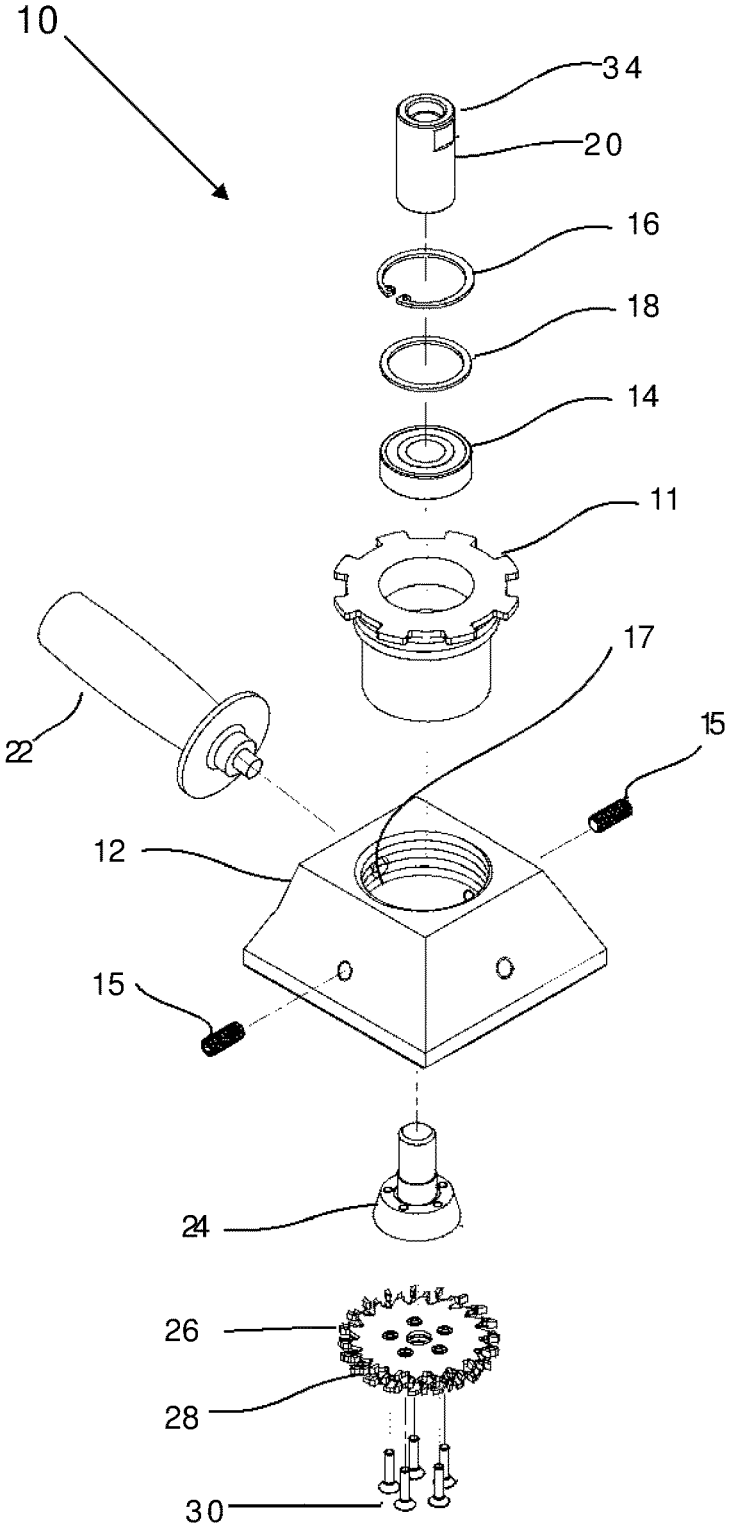
FIG. 2 illustrates a detailed exploded isometric view of the present invention with parts shown.

FIG. 2 provides a perspective exploded isometric view of a preferred embodiment of the present router housing invention (Brace Setter generally shown as 10.) An aluminum housing 12 has a central threaded aperture 17, which interfaces with a cylindrical aluminum cutting depth adjuster 11. The depth adjuster 11 is locked in place by two set screws 15 which fit into apertures 13 in the housing 12. An arbor 24 fitting up through the center of the bushing, has a five bolt circle 36 (on FIG. 1) section for anchoring three saw blades 26. Between the three saw blades are two spacers 28. There is a snap ring retainer clip 16 that applies pressure against a spring wave washer 18 that holds bearing 14 in place. The arbor 24 is passed through bearing 14, then threaded onto coupling 20, which also has a flat spot 34 for supporting a wrench.

At the bottom of the arbor is a five bolt circle section for anchoring three saw blade layers 26 between the three saw blades are two spacers 28. The saw blades are secured into place by way of five number 8×32 screws 30. A safety handle 22, with a large shroud to protect the hands and fingers, allows the user to firmly grasp the tool. There is also an optional second support handle location.

Figure 3:
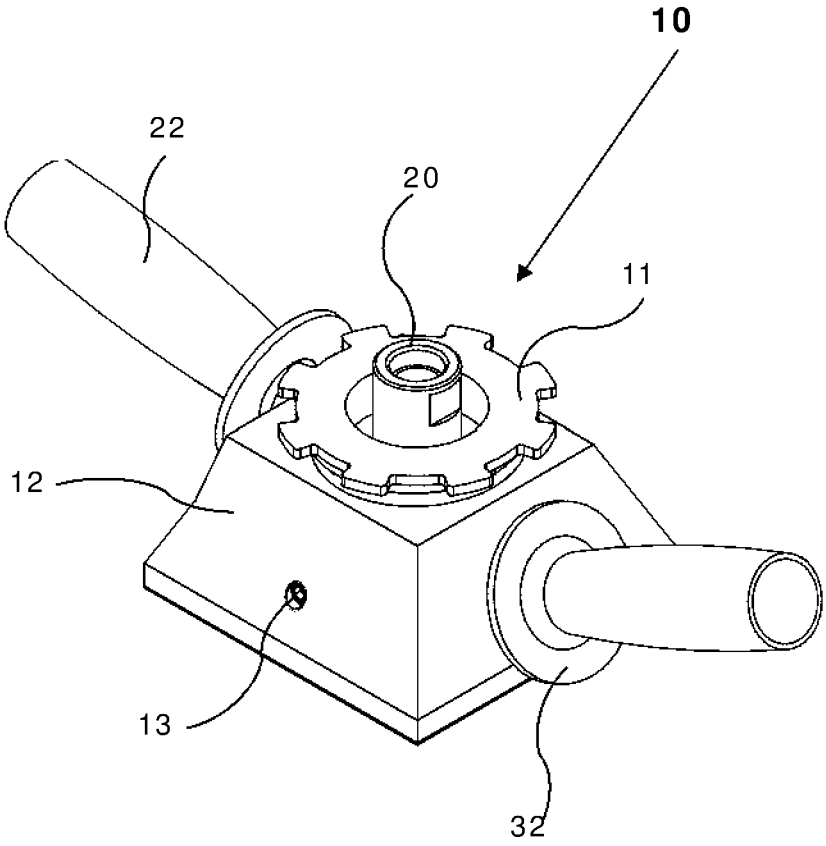
FIG. 3 provides a top perspective view showing the saw blades.

FIG. 3 provides a top perspective view of the present invention 10, showing the handle 22 with a shroud 32. There is an option to add a second handle 22. There is a coupling 20, which enables operably connecting to a right angle grinder by way of ⅝"×11 threads. It can easily be transformed into a precision wood router, that having an adjustable routing depth with a range of 0 to ⅜ of an inch deep (1 cm) for the purpose of cutting recesses or grooves in building materials such as lumber. The cutting depth adjuster 11 allows for the adjustable cutting depth.

What is claimed is:

1. A routing apparatus for cutting grooves in surfaces at a range of depths, the routing apparatus comprising:

a) a housing having a central threaded aperture on a first side of the housing and a second aperture with a first diameter on the second side of the housing;

b) a set of saw blades with a second diameter, wherein said second diameter is less than said first diameter wherein the set of saw blades can move into and out of the second aperture to determine the cutting depth;

c) at least one handle attached to a side of said housing;

d) a cutting depth adjuster comprising:

an adjustment bushing having central bore, the adjustment bushing is configured for operational engagement within said central threaded aperture;

a coupling mounted within the central bore of the adjustment bushing;

one side of said coupling has female threads which are operationally engageable with male threads of a common right-angle grinder;

the opposite side of said coupling is connected to said set of saw blades;

wherein turning the adjustment bushing adjusts the cutting depth of said set of saw blades.

2. The routing apparatus of claim 1 wherein said set of saw blades is three.

3. The routing apparatus of claim 1 wherein said cutting depth adjuster bushing can be locked in place temporarily with at least one set screw.

* * * * *